US007060161B2

(12) United States Patent
Hirooka et al.

(10) Patent No.: US 7,060,161 B2
(45) Date of Patent: Jun. 13, 2006

(54) METHOD FOR RESTRAINING DEFORMATION OF NIP ROLL

(75) Inventors: Hideki Hirooka, Mihara (JP); Kiyoshi Nakano, Mihara (JP); Hiroshi Miura, Mihara (JP); Atsuo Sueoka, Fukuoka (JP); Takahiro Ryu, Oita (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 10/797,065

(22) Filed: Mar. 11, 2004

(65) Prior Publication Data

US 2005/0223913 A1 Oct. 13, 2005

(51) Int. Cl.

| | |
|---|---|
| ***D21F 3/04*** | (2006.01) |
| ***B30B 3/04*** | (2006.01) |
| ***B30B 15/28*** | (2006.01) |
| *D21G 3/04* | (2006.01) |

(52) U.S. Cl. ..... 162/199; 162/205; 162/358.1; 162/361; 100/160; 100/168; 100/176; 101/92; 101/484

(58) Field of Classification Search ..... 162/198, 162/199, 204–206, 263, 358.1, 358.5, 360.2, 162/360.3, 272; 100/35, 37, 43, 155 R, 161, 100/162 R, 168–171, 176, 160; 492/9–11, 492/20; 101/92, 484, 485, 494

See application file for complete search history.

(56) References Cited

U.S. PATENT DOCUMENTS

| | | | | |
|---|---|---|---|---|
| 4,909,905 | A * | 3/1990 | Ilmarinen et al. | 162/360.3 |
| 4,910,842 | A * | 3/1990 | Brendel | 492/10 |
| 6,251,207 | B1 * | 6/2001 | Schultz et al. | 156/209 |
| 6,615,709 | B1 * | 9/2003 | Suomi et al. | 100/41 |
| 6,851,356 | B1 * | 2/2005 | Haag | 100/47 |

OTHER PUBLICATIONS

Takahiro Ryu, et al., "Polygonal Deformation of Roll-Covering Rubber (In Case Viscoelastic Deformation of a Pair of Rolls is Taken into Account", Transactions of the Japan Society of Mechanical Engineers (C Version), vol. 59, No. 567, Nov. 1993, pp. 3349-3356 (with English translation).

* cited by examiner

*Primary Examiner*—Eric Hug
(74) *Attorney, Agent, or Firm*—Oblon, Spivak, McClelland, Maier & Neustadt, P.C.

(57) ABSTRACT

There is provided a method for restraining deformation of a nip roll, in which polygonal deformation of nip rolls that are in contact with each other is restrained, so that vibration produced by the deformation is decreased.

The diameter ratio between the first and second nip rolls 1 and 2 is set at a value different from 1, by which both of the numbers of polygon sides of the rolls 1 and 2 are prevented from becoming integers or values close to integers. Thereby, polygonal deformation of nip rolls that are in contact with each other, so that vibration produced by the deformation is decreased.

4 Claims, 6 Drawing Sheets

METHOD FOR RESTRAINING DEFORMATION OF NIP ROLL

BACKGROUND OF THE INVENTION

1. Field of the Invention

The present invention relates to a method for restraining deformation of a nip roll used in a size press process of a paper-making machine or in other applications.

2. Description of the Related Art

For example, in the size press process of paper-making machine, paper is pressed by two nip rolls that are brought into contact with each other by pressure.

In the paper-making machine industry, there is a tendency toward high speed. However, the nip roll shows a tendency to vibrate especially at the time of high-speed rotation, which causes a hindrance to high-speed rotation.

This vibration is ascribed to a phenomenon that the same portion of each roll is strongly nipped because of the relationship between the rotational speed of each roll and the natural frequency of a vibration system including the rolls, supporting means therefor, and the like, whereby the roll is deformed into a polygonal shape. Conventionally, since the diameter ratio between nip rolls is set at 1, the same portions thereof are nipped strongly, so that large vibration occurs due to the deformation into the polygonal shape.

As measures against the deformation of nip roll, an increase in roll diameter can be thought of. If the roll diameter is increased, the rotational speed of the roll can be decreased by the amount of increase in the circumferential speed of roll. If the rotational speed decreases, time for restoring the deformation of roll is secured, so that the growth of deformation is restrained. However, such measures increase the size of roll, which leads to the increase in roll cost and installation space.

SUMMARY OF THE INVENTION

The present invention has been made in view of the above situation, and accordingly an object thereof is to provide a method for restraining deformation of a nip roll, in which polygonal deformation of nip rolls that are in contact with each other is restrained effectively, so that vibration produced by the deformation is decreased.

To achieve the above object, in the present invention, the diameter ratio between first and second nip rolls which nip a sheet material is set at a value different from 1. According to the present invention, the same portions of the first and second nip rolls are prevented from being nipped strongly in a predetermined operation speed range. As a result, polygonal deformation of these nip rolls is restrained.

The diameter ratio between the first and second nip rolls is set so that when the number of polygon sides of polygonal deformation of the first nip roll, which is defined by the ratio of the frequency of a vibration system including the rolls to the rotational speed of the first nip roll, is an integer $N_1$, the number of polygon sides of the second nip roll, which is defined by the ratio of the frequency of the vibration system to the rotational speed of the second nip roll, has the following value:

$$N_1 \pm j + a$$

Where, j=0, 1, 2, 3, . . .

$$0 < a < 1$$

If the number of polygon sides of the second nip roll is set in this manner, both of the numbers of polygon sides of the first and second nip rolls are prevented from becoming integers, so that polygonal deformation of these rolls is restrained. Therefore, a vibration trouble due to polygonal deformation of nip rolls is prevented, and the sheet material such as a paper can be run steadily by being nipped surely, which contributes to high-speed running of sheet material. Moreover, the steady running can be realized without decreasing the roll diameter or without increasing the roll diameter too much, so that an application system such as a paper-making machine can be operated at a higher speed without the increase in size and cost.

The constant a may be set at 0.1 to 0.9, preferably at 0.5.

The first and second nip rolls are effective as nip rolls provided, for example, in a size press process of a paper-making machine.

DETAILED DESCRIPTION OF THE PREFERRED EMBODIMENTS

Figure 1:
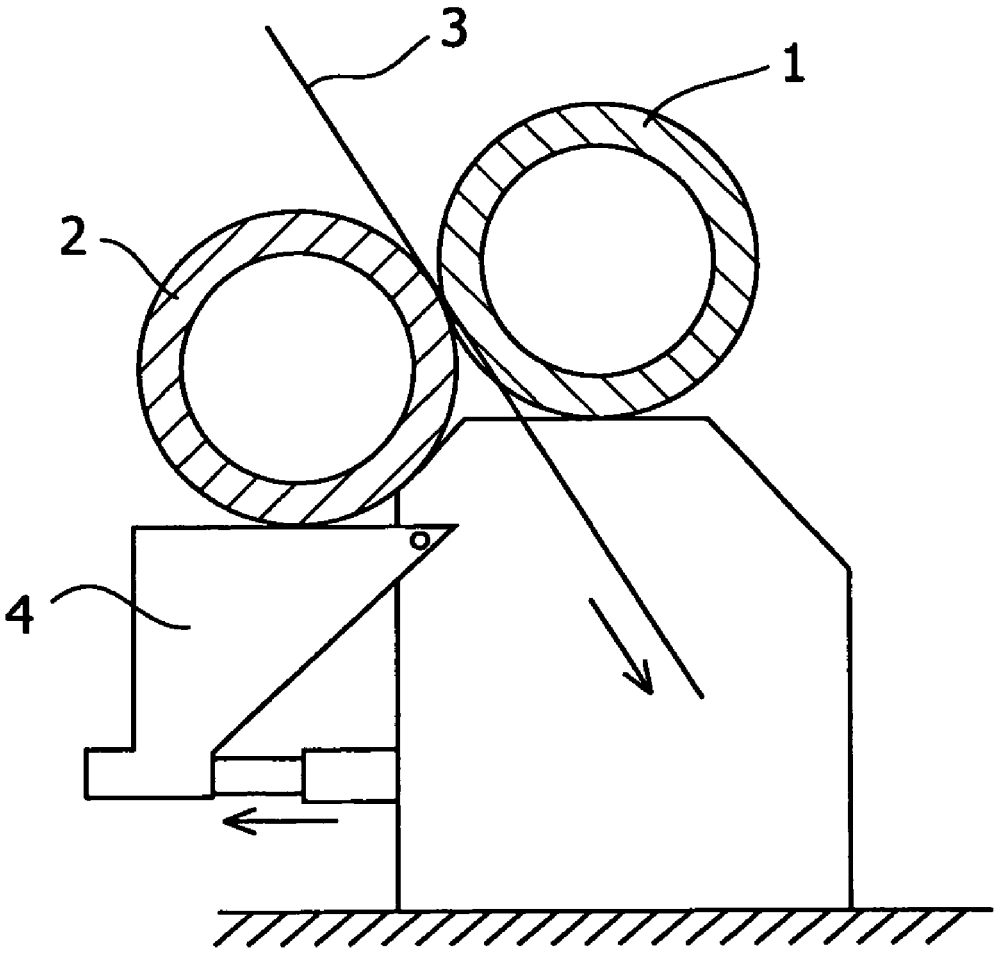
FIG. 1 is a schematic view typically showing an installation status of nip rolls provided in a size press process of a paper-making machine.
Figure 2:
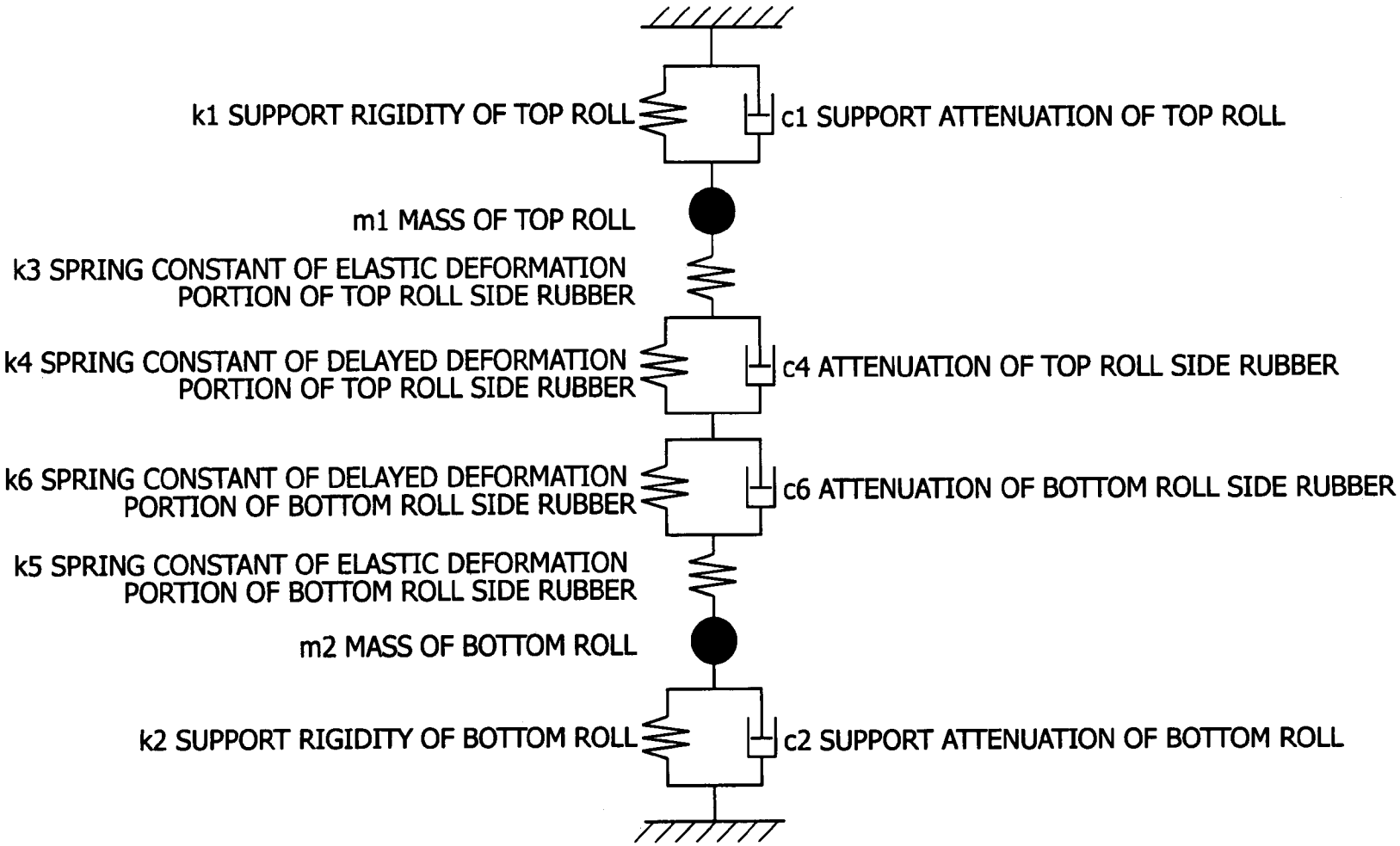
FIG. 2 is a diagram of an equivalent model of a vibration system including the nip rolls shown in FIG. 1.

FIG. 1 shows a pair of nip rolls 1 and 2 provided in a size press process of a paper-making machine. FIG. 2 shows a model of a vibration system including the rolls 1 and 2, supporting means therefor, and the like.

In FIG. 1, the outer layer portions of the top roll 1 and the bottom roll 2 each are formed of a rubber with a thickness of, for example, 20 mm, and the top roll 1 and the bottom roll 2 nip a paper 3 sent from a preceding process (drying process). The bottom roll 2 is urged against the top roll 1 by a pressing force of a pressing member 4 supported so as to be able to oscillate.

The rolls 1 and 2 are deformed into a polygonal shape because of the relationship between the rotational speeds thereof and the natural frequency of a vibration system including the rolls, supporting means therefor, and the like (see FIG. 2). This polygonal deformation means a phenomenon in which the same portion of each roll 1, 2 is deformed by repeated strong nipping operation, and this deformation grows gradually, by which a polygonal pattern is formed. This phenomenon takes place when both of the ratios of natural frequency to roll rotational speed for individual rolls 1, 2 become integers or values close to integers. Here, one of the top roll 1 and the bottom roll 2 is referred to as a reference roll and the other as a mating roll, and the ratio of the diameter $D_2$ of the mating roll to the diameter $D_1$ of the reference roll is taken as $$\gamma=D_2/D_1 \tag{1}$$

whereby the number of polygon sides of a polygonal deformation pattern of each roll is expressed as number of polygon sides of reference roll $$n_1=60\pi D_1 f_0/V \tag{2}$$

number of polygon sides of mating roll $$n_2 = 60\pi D_2 f_0 / V = 60\pi y D_1 f_0 / V \tag{3}$$

where, $f_0$: natural frequency of vibration system shown in FIG. 2 (Hz)

V: standard paper feed speed (m/min)

Figure 3:
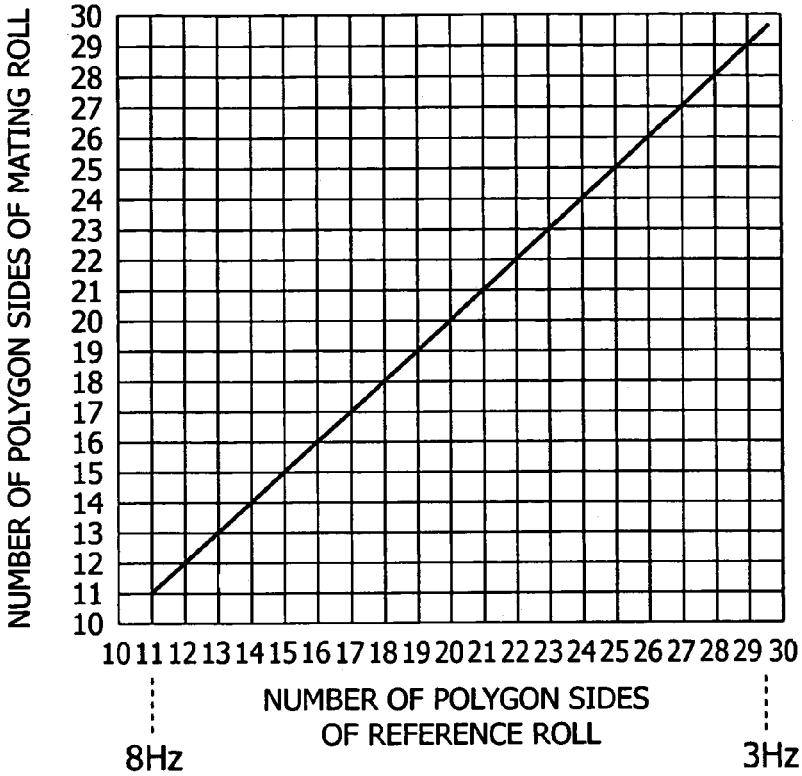
FIG. 3 is a graph typically showing the relationship between the number of polygon sides of a reference roll and that of a mating roll in a case where the diameter ratio of the mating roll to the reference roll is set at 1.
Figure 4:
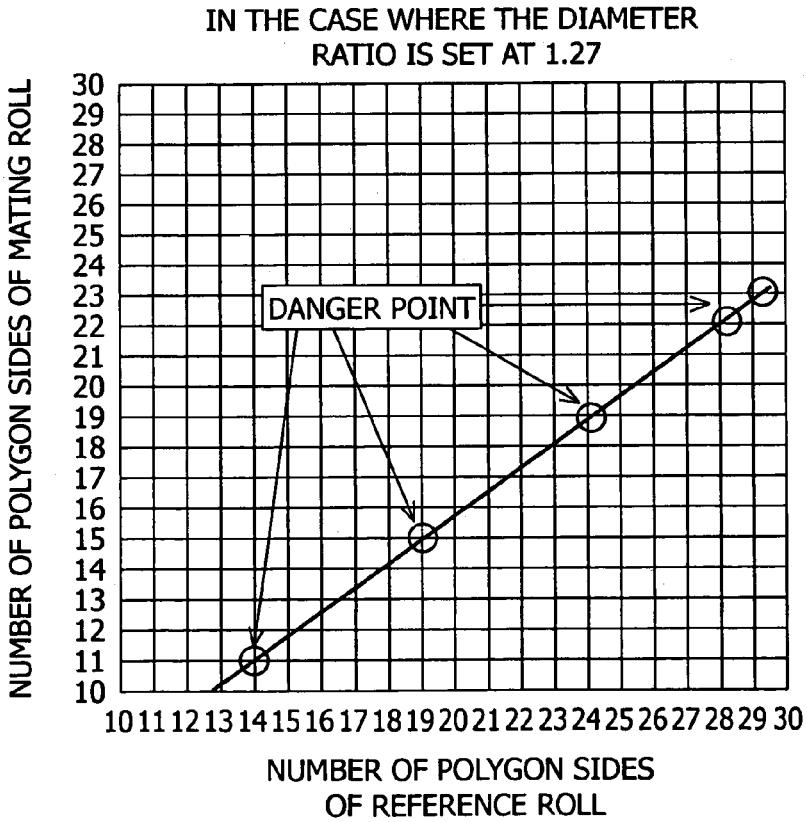
FIG. 4 is a graph typically showing the relationship between the number of polygon sides of a reference roll and that of a mating roll in a case where the diameter ratio of the mating roll to the reference roll is set at 1.27.
Figure 5:
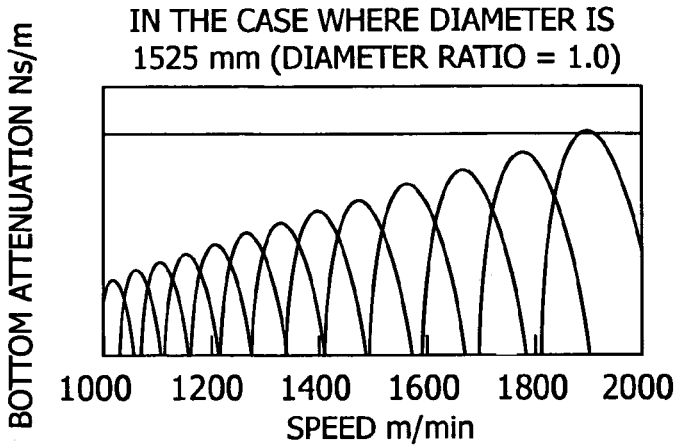
FIG. 5 is a graph typically showing the relationship between paper feed speed and bottom attenuation in a case where the diameter ratio of a mating roll to a reference roll is set at 1.
Figure 6:
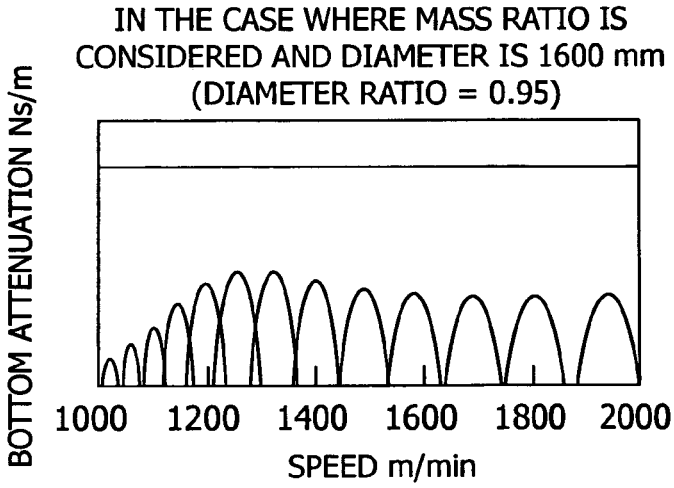
FIG. 6 is a graph typically showing the relationship between paper feed speed and bottom attenuation in a case where the diameter ratio of a mating roll to a reference roll is set at 0.95.
Figure 7:
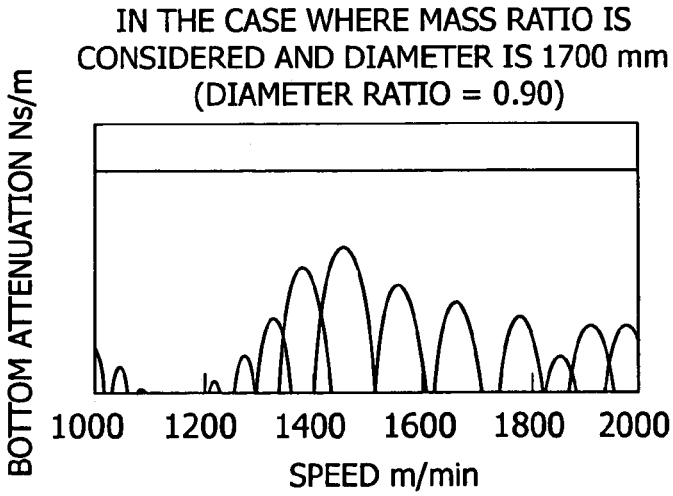
FIG. 7 is a graph typically showing the relationship between paper feed speed and bottom attenuation in a case where the diameter ratio of a mating roll to a reference roll is set at 0.90.
Figure 8:
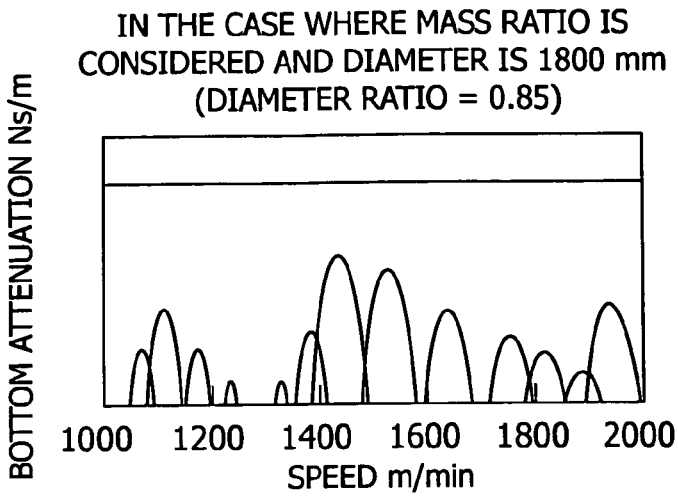
FIG. 8 is a graph typically showing the relationship between paper feed speed and bottom attenuation in a case where the diameter ratio of a mating roll to a reference roll is set at 0.85.
Figure 9:
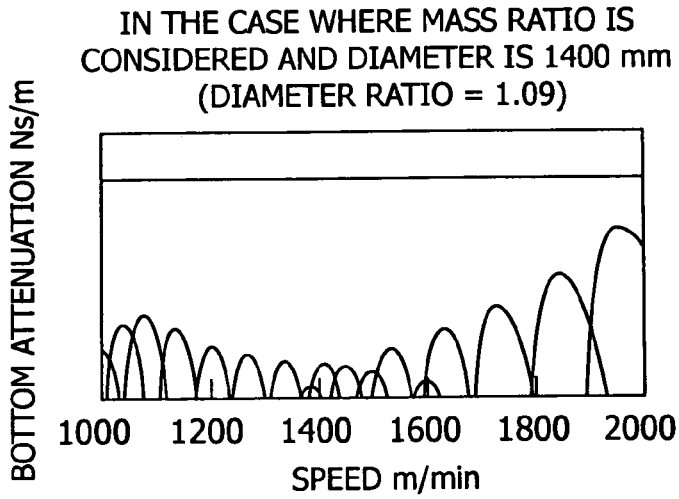
FIG. 9 is a graph typically showing the relationship between paper feed speed and bottom attenuation in a case where the diameter ratio of a mating roll to a reference roll is set at 1.09.
Figure 10:
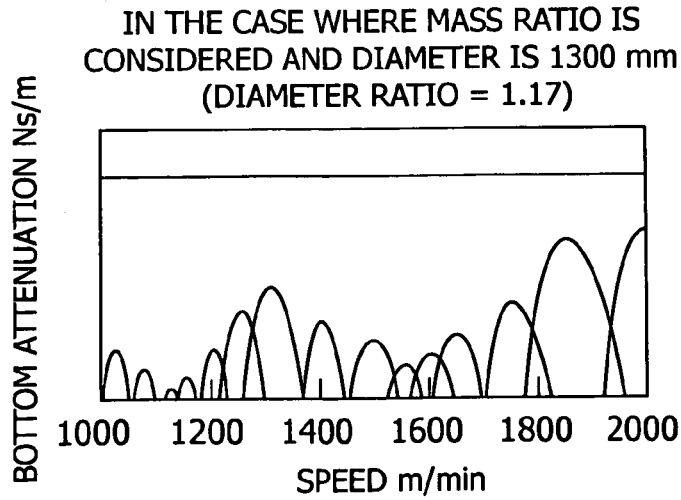
FIG. 10 is a graph typically showing the relationship between paper feed speed and bottom attenuation in a case where the diameter ratio of a mating roll to a reference roll is set at 1.17.
Figure 11:
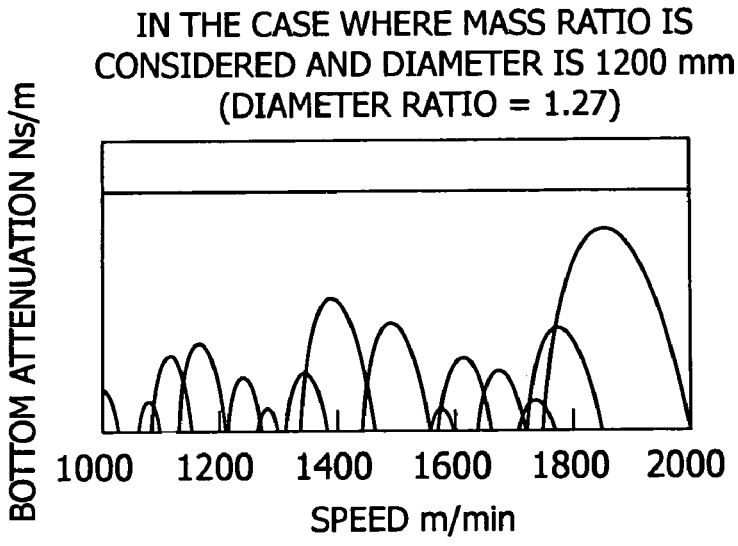
FIG. 11 is a graph typically showing the relationship between paper feed speed and bottom attenuation in a case where the diameter ratio of a mating roll to a reference roll is set at 1.27.

FIG. 3 shows the relationship of the number of polygon sides between the rolls in a case where the rotational speed of the reference roll is changed in the range of 3 to 8 Hz (needless to say, the rotational speed of the mating roll also changes so as to have the same circumferential speed) when the natural frequency $f_0$ is 89 Hz and the diameter ratio between the rolls is 1.0. FIG. 4 shows the same relationship when the diameter ratio between the rolls is 1.27.

When the diameter ratio between the rolls is 1.0 (same diameter), the polygonal shapes of the rolls are always the same. Therefore, a state in which both of the numbers of polygon sides $n_1$ and $n_2$ of the rolls are integers occurs frequently in the aforementioned rotational speed range. In contrast, when the diameter ratio between the rolls is 1.27, as shown in FIG. 4, both of the numbers of polygon sides of the rolls are integers or values close to integers only at points indicated by circles. The phenomenon that both of the numbers of polygon sides of the rolls are not integers means that the same portions of the rolls do not nip each other strongly, that is, the growth of polygonal deformation pattern is restrained.

To show this fact theoretically, unstable regions caused by polygonal deformation are calculated with the diameter ratio being a parameter as shown in FIGS. 5 to 11.

These calculation results were obtained when the diameter of the reference roll was 1525 mm. Also, in FIGS. 5 to 11, the abscissas represent paper feed speed (machine speed) and the ordinates bottom represent attenuation (corresponding to a force of vibration acting on a support system).

Bell-shaped attenuation lines in each figure show their peaks at a paper feed speed at which both of the numbers of polygon sides of the rolls are integers or values close to integers. Regions surrounded by these bell-shaped lines are unstable regions caused by polygonal deformation.

As is apparent from a comparison between FIG. 5 and FIGS. 6 to 11, when the diameter of the mating roll is made different from the diameter of 1525 mm of the reference roll, the unstable regions decrease. In each figure, the unstable region decreases with decreasing paper feed speed. This is because as the paper feed speed decreases, time for restoring from the deformed state is kept long.

As is apparent from the above consideration, the polygonal deformation pattern is liable to occur when both of the numbers of polygon sides $n_1$ and $n_2$ of the reference roll and the mating roll are integers or values close to integers. Therefore, if the number of polygon sides of the mating roll is prevented from becoming an integer or a value close to an integer when the number of polygon sides of the reference roll is an integer at the standard paper feed speed V (standard circumferential speed of the reference roll and the mating roll) or a speed close to V, the occurrence of polygonal deformation pattern in a certain paper feed speed range is restrained.

The following is a description of a method for preventing the number of polygon sides of the mating roll from becoming an integer when the number of polygon sides of the reference roll is an integer.

In Equation (1), the number of polygon sides $N_1$ of integer that is determined when the same speed is changed in the vicinity of the standard paper feed speed V is defined, and the same speed at this time is taken as $V_0$. When the number of polygon sides of the reference roll is the integer $N_1$, the condition that the number of polygon sides $n_2$ of the mating roll is not an integer is given by the following equation:

$$n_2=N_1\pm j+a \tag{4}$$

where, j=0, 1, 2, 3, . . .

$$0<a<1$$

The aforementioned diameter ratio γ is determined from Equations (3) and (4). At this time, $V_0$ is used as the speed V in Equation (3).

If the diameters $D_1$ and $D_2$ of the reference roll and the mating roll are set so as to provide the diameter ratio γ (≠1) determined as described above, both of the numbers of polygon sides of these rolls are prevented from becoming integers, so that the occurrence of the aforementioned polygonal deformation pattern is restrained in the vicinity of the standard paper feed speed.

The constant a in Equation (4) should be set at a value in the range of 0.1 to 0.9, preferably 0.4 to 0.6, and further preferably at a value of 0.5.

Next, a specific example will be described.

When the diameter $D_1$ of the reference roll is taken as 1.5 m, the natural frequency of vibration system as 89 Hz, and the standard paper feed speed V as 1700 m/min, from Equation (2), the number of polygon sides $n_1$ of the reference roll is calculated as $$n_1=60\pi\times1.5\times89/1700=14.8$$

The number of polygon sides $N_1$ closest to $n_1=14.8$ is 15. Therefore, the paper feed speed $V_0$ at which the polygonal deformation pattern is liable to occur in the vicinity of the standard paper feed speed V is provided at the time when $n_1=N_1=15$ in Equation (2). This speed $V_0$ is calculated as $$V_0=60\pi\times1.5\times89/15=1678 \text{ m/min}$$

based on Equation (2).

In order to prevent the occurrence of polygonal deformation pattern when the number of polygon sides $n_1$ of the reference roll is $n_1=N_1=15$, the number of polygon sides $n_2$ of the mating roll has only to be set so as to be $n_2=15\pm j+a$ based on Equation (4).

Comparing the case where the number of polygon sides $n_2$ is set so as to be $n_2=15+j+a$ with the case where it is set so as to be $n_2=15-j+a$, from the relationship given by Equations (1) and (3), the diameter of the mating roll is set larger in the former case than in the latter case.

From the viewpoint of more effectively preventing the occurrence of polygonal deformation pattern, it is advantageous to increase the diameter of the mating roll. The reason for this is that at a predetermined paper feed speed, as the diameter of roll increases, time for the roll to restore from deformation is kept long. On the other hand, from the viewpoint of cost reduction, it is undesirable to increase the diameter of the mating roll too much.

Thereupon, in this example, $n_2$ and j are set so as to be $n_2=15+j+a$ and j=0. In this case, if the optimum value 0.5 is given as the constant a, $n_2$ is calculated as $$n_2=15+0.5=15.5$$

If the aforementioned calculated value $V_0=1678$ is given as the speed V in Equation (3), the diameter ratio γ is calculated as $$\gamma=15.5\times1678/60\pi\times1.5\times89=1.034$$

Therefore, the optimum diameter of the mating roll for preventing the occurrence of polygonal deformation pattern is calculated as $$D_2=1.304\times15=1.55 \text{ m}$$

from Equation (1).

Figure 12:
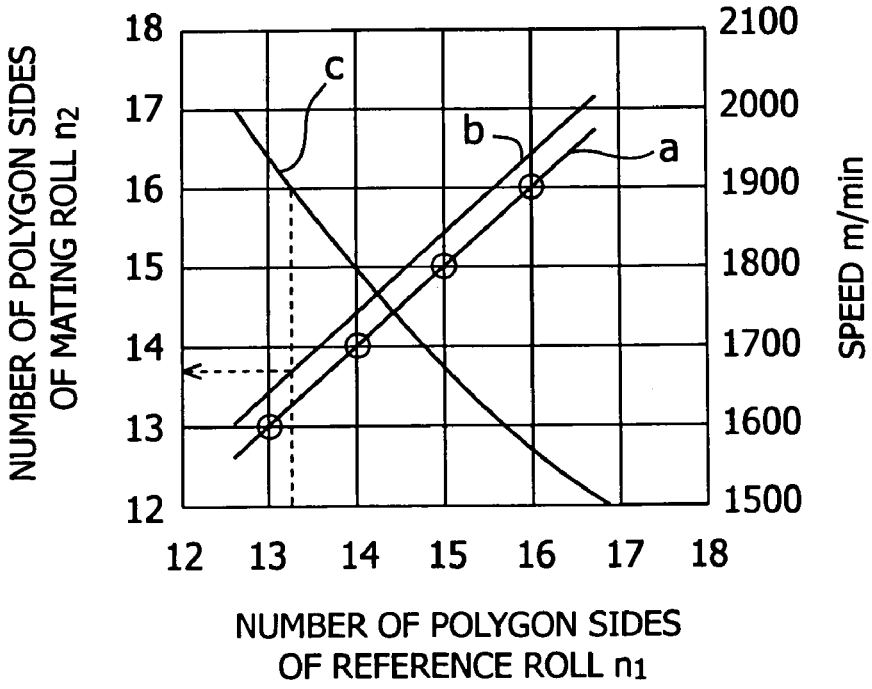
FIG. 12 is a graph typically showing the relationship of the number of polygon sides between a reference roll and a mating roll and the relationship between the number of polygon sides of the reference roll and paper feed speed in a specific example of the present invention.

In FIG. 12, line a shows the relationship of the number of polygon sides between the rolls when the reference roll and the mating roll have the same diameter (1.5 m), line b shows the same relationship in the case of the above-described example in which the diameter $D_1$ of the reference roll is set at 1.5 m and the diameter $D_2$ of the mating roll at 1.55 m, and line c shows the relationship between the number of polygon sides of the reference roll and paper feed speed.

As is apparent from FIG. 12, when the reference roll and the mating roll have the same diameter (1.5 m), a state in which both of the numbers of polygon sides of these rolls are integers occurs frequently in the paper feed speed range of 1500 to 2000 m/min (see circle marks on line a). This means that when the paper feed speed is changed from the standard paper feed speed V, a chance for occurrence of polygonal deformation pattern on the rolls increases.

In contrast, according to the above-described example in which the diameter ratio between the rolls is set so as to ensure the relationship of line b, a state in which both of the numbers of polygon sides of these rolls are integers does not occur in the paper feed speed range of 1500 to 2000 m/min. Therefore, the polygonal deformation pattern is prevented from occurring on the rolls in the aforementioned range of high paper feed speed, by which proper size press without vibrations can be implemented.

Incidentally, in the relationship shown by line b in FIG. 12, as indicated by dotted lines, when the number of polygon sides $n_1$ of the reference roll is about 13.2, the number of polygon sides $n_2$ of the mating roll becomes about 13.7. Also, the paper feed speed at this time is about 1900 m/min.

In the above-described embodiment, the present invention is applied to a nip roll used in a size press process of a paper-making machine. However, the present invention can be applied effectively to a nip roll used in a press process, a calender process, and the like of a paper-making machine, or to a nip roll used in a printing machine. Also, the present invention is effective in restraining the deformation of a resin or metallic nip roll.

What is claimed is:

1. A method for restraining deformation of a nip roll, which is used to restrain deformation of first and second nip rolls which nip a sheet material, the method comprising:

setting a diameter ratio between said first and second nip rolls at a value different from 1; and setting the diameter ratio between said first and second nip rolls so that when a number of polygon sides of polygonal deformation of said first nip roll, which is defined by a ratio of the frequency of a vibration system including said rolls to a rotational speed of said first nip roll, is an integer $N_1$, a number of polygon sides of said second nip roll, which is defined by the ratio of the frequency of said vibration system to a rotational speed of said second nip roll, has the following value:

$$N_1\neq j+a$$

where, j=0, 1, 2, 3, . . .

$$0<a<1.$$

2. The method for restraining deformation of a nip roll according to claim 1, wherein said constant a is set at 0.1 to 0.9.

3. The method for restraining deformation of a nip roll according to claim 1, wherein said constant a is set at 0.5.

4. The method for restraining deformation of a nip roll according to any one of claims 1, 2 and 3, including providing said first and second nip rolls in a paper-making machine or a printing machine.

* * * * *